US007607934B1

(12) United States Patent
Yang

(10) Patent No.: US 7,607,934 B1
(45) Date of Patent: Oct. 27, 2009

(54) INSTANT INSERTION AND EXTRACTABLE WIRE CONNECTOR

(75) Inventor: Wen-Ho Yang, Taipei County (TW)

(73) Assignee: Sun-Lite Sockets Industry Inc., Taoyuan (TW)

( * ) Notice: Subject to any disclaimer, the term of this patent is extended or adjusted under 35 U.S.C. 154(b) by 0 days.

(21) Appl. No.: 12/320,375

(22) Filed: Jan. 26, 2009

(51) Int. Cl.
*H01R 4/24* (2006.01)

(52) U.S. Cl. ..... 439/441

(58) Field of Classification Search ..... 439/441, 439/442, 439
See application file for complete search history.

(56) References Cited

U.S. PATENT DOCUMENTS 7,109,429 B1 * 9/2006 Lee ..... 200/283
7,507,106 B2 * 3/2009 Keswani et al. ..... 439/439

* cited by examiner

*Primary Examiner*—Phuong K Dinh
(74) *Attorney, Agent, or Firm*—Bacon & Thomas, PLLC

(57) ABSTRACT

This invention is to provide an instant insertion and extractable wire connector, comprising a shell, a clip, at least two wire extracting chunks, an insert and a cover. One side of the clip is extended to form at least two separated curved segments, and an arc is located next to the curved segments, where its bottom end forms a holding edge. And each curved segment has an enhanced tendon. The wire extracting chunks are placed at the shell, where its inner end inserted in the corresponding cavity has a top indent, for pressing the holding edge of the clip for the extraction purpose. Its middle part is provided with a clasp chunk at a side to confine the moving distance of the wire extracting chunk. The outer end is provided with a push end for the pushing purpose. Accordingly, this invention can accomplish promptness in the insertion and extraction of an electric wire.

2 Claims, 3 Drawing Sheets

INSTANT INSERTION AND EXTRACTABLE WIRE CONNECTOR

BACKGROUND OF THE INVENTION

1. Field of the Invention

This invention relates generally to electrical wire connectors and more particularly to an instant insertion and extractable wire connector featuring promptness in the insertion and extraction of an electric wire.

2. Description of the Prior Art

Generally, electric connectors are used in between electric power consuming articles or accessories and the power supply; therefore, the structural combination of the electrical connector is aiming at enabling the user to operate the wire connection with ease and free of damage during the connecting operation, and it is essential that the connector is connected firmly in place without high possibility to come off. However, some prior art wire connectors are complicated in the structural combination design for the firm connection, which deteriorates the wire connection considerably; while some others have defects in the directional structure design for guiding the wire connection, which makes the user inferior in operating the connection effectively or the damage in connection by the improper operation under the situation that the user is unfamiliar with the electrical connection; moreover, it could bring in flaws as causing damage to the electric power consuming articles or accessories. This invention hence improves the structural combination of the electric wire connector in view of the handiness and safety of the user.

SUMMARY OF THE INVENTION

In light of the aforesaid drawbacks, this inventor conceived deeply the idea for the design of the invention, and eventually the longtime endeavors gave birth to this invention.

The objective of the present invention is to provide an unsophisticated structure, the instant insertion and extractable wire connector featuring promptness in inserting and extracting for an electric wire.

The other objective of the present invention is to provide an instant insertion and extractable wire connector incorporating capabilities of single in multiple out or multiple in single out for the electrical connection.

To accomplish the aforementioned objects, this invention is an instant insertion and extractable wire connector, comprising a shell, a clip, at least two wire extracting chunks, an insert and a cover; the shell has its internal as the lodging space and a plurality of positioning dens as well for the positioning purpose, is provided with at least two through holes at its bottom, and has at least two cavities at a side of its top; the clip is formed out of conductive material which is lodged in the internal of the shell and held fixedly, where its one side is extended to form at least two separated curved segments. An arc is located next to the curved segment, where its bottom end forms a holding edge, and each curved segment has an enhanced tendon, where a gap is laid between two adjacent curved segments and between two adjacent arcs; the wire extracting chunks are formed by insulating material, which are one-to-one lodged in the cavities, and each wire extracting chunk inserted in the corresponding cavity has a top indent at its inner end, where its middle part is provided with a clasp chunk at a side, while its outer end is a push end; once the wire extracting chunk is lodged in the cavity, the clasp chunk is positioned at the inner wall edge of the cavity, which could confine the moving distance of the wire extracting chunk; the insert, lodged in the shell for a fixing, is in contact with the clip and is made up of conductive material, where its one side is provided with voids which has the same number as that of the wire extracting chunks, and each void is penetrated by the corresponding wire extracting chunk; the cover is capped on the shell for a fixed joining.

In this invention, there is a testing hole located in the side of the through holes on the shell, where the testing hole leads to the internal of the shell.

DETAILED DESCRIPTION OF THE INVENTION

To achieve the foregoing objects of the present invention, the techniques adopted and the achievable function are detailed described with reference to the following preferred exemplified embodiment and the accompanying drawings for a thorough comprehension.

Figure 1:
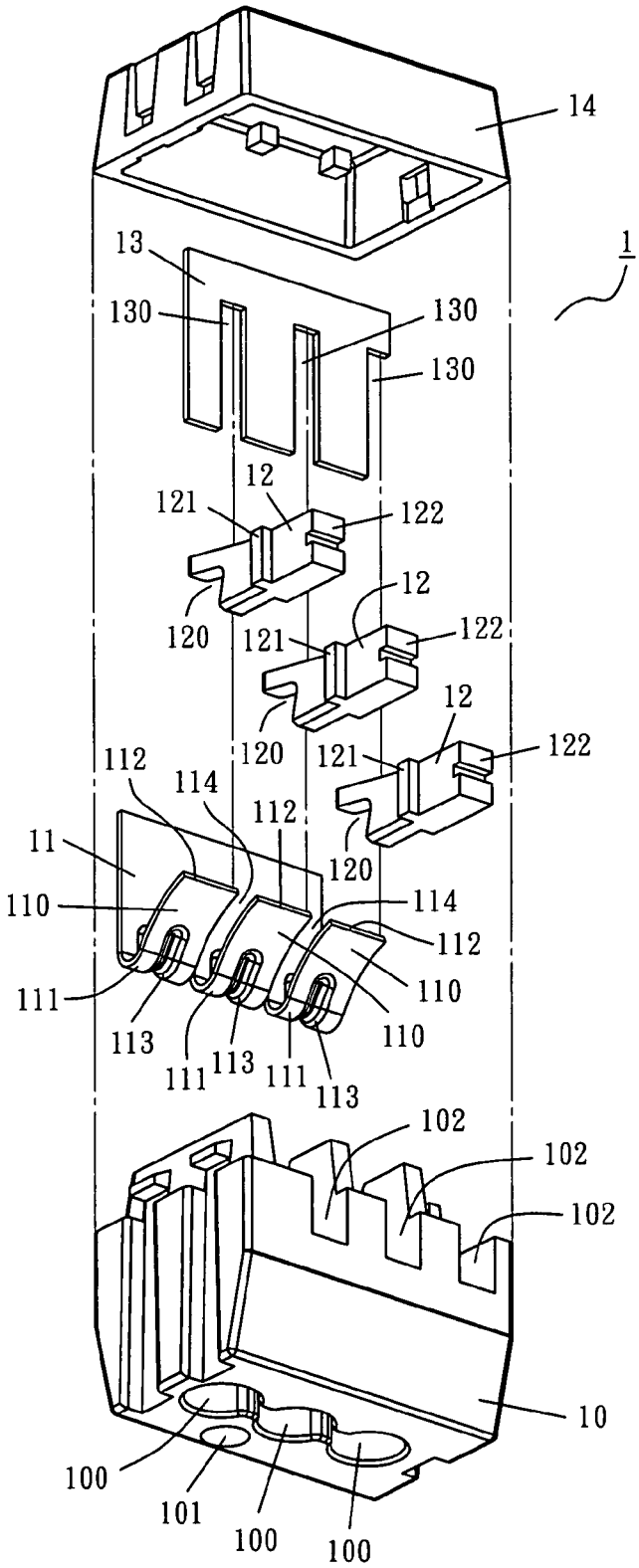
FIG. 1 is a three-dimensional exploded view of the exemplified embodiment of the present invention.
Figure 2:
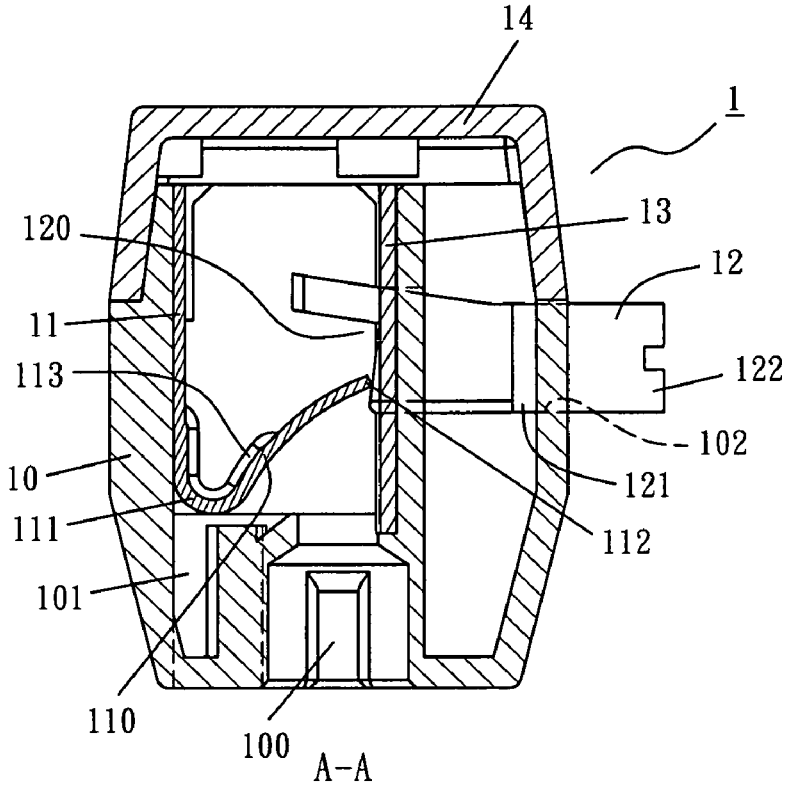
FIG. 2 is an assembled sectional view of the exemplified embodiment of the present invention.
Figure 3:
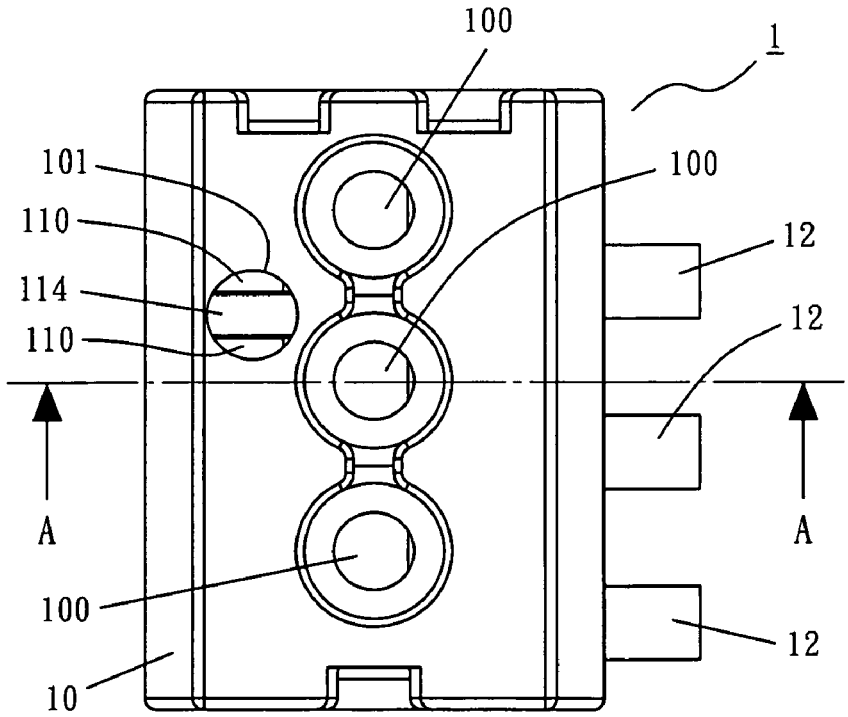
FIG. 3 is an assembled bottom view of the exemplified embodiment of the present invention.

Referring to FIGS. 1-3, the exemplified embodiment of the present invention as a whole is an electric wire connector 1, comprising a shell 10, a clip 11, a plurality of (at least two) wire extracting chunks 12, an insert 13 and a cover 14; where the shell 10 has its internal as the lodging space and a plurality of positioning dens for the positioning purpose, is provided with a plurality of (at least two) through holes 100 at its bottom, and has a testing hole 101 besides the through holes 100, where its top is provided with a plurality of (at least two) cavities 102 at its one side; the clip 11 is formed out of conductive material which is lodged in the internal of the shell 10 and held fixedly, where its one side is extended to form a plurality of (at least two) separated curved segments 111. An arc 110 is located next to the curved segments 111, where its bottom end forms a holding edge 112, and each curved segment 111 has an enhanced tendon 113, where a gap 114 is laid between two adjacent curved segments 111 and between two adjacent arcs 110.

The wire extracting chunks 12 are formed out of insulating material, which are one-to-one lodged in the cavities 102 respectively, and each wire extracting chunk 12 inserted in the corresponding cavity 102 has partial protrusion forming a top indent 120 at its inner end, where its middle part is provided with a clasp chunk 121 at its side, while its outer end is a push end 122; once the wire extracting chunk 12 is lodged in the cavity 102, the clasp chunk 121 is positioned at the inner wall edge of the cavity 102 so that the clasp chunk 121 is then barricaded by the inner wall edge of the cavity 102, which in turn confines the moving distance of the wire extracting chunk 12, that is, the wire extracting chunk 12 moves toward the internal of the shell 10, while its retreat can only reach the location barricaded by the inner wall edge of the cavity 102, instead of complete retreat from the cavity 102; as the wire extracting chunks 12 are one-to-one lodged in the cavities 102 respectively, the top indent 120 of each wire extracting chunk 12 is just right touching the corresponding holding edge 112, which means each holding edge 112 is placed in the corresponding top indent 120.

The insert 13, lodged in the shell for a fixing, is in contact with the clip 11 and is made out of conductive material, where its one side is provided with voids 130 (including the half-void at the most left) which has the same number as that of the wire extracting chunks 12, and each void 130 is penetrated by the corresponding wire extracting chunk 12, followed by a hold of the wire extracting chunk 12; as the shell 10, the clip 11, the wire extracting chunks 12 and the insert 13 are settled for the assembly, the cover 14 is lastly placed on the shell 10 and combined with the shell 10 firmly; meanwhile, the clip 11, the wire extracting chunks 12, and the insert 13 assembled in the shell 10 are under an auxiliary fixing. The internal of the present invention after the assembly is accomplished is shown in FIG. 2. At this moment, the electric wire is not yet inserted in the connector, the holding edge 112 at the bottom end of the arc 110 of the clip 11 is propped against the top indent 120 of the corresponding wire extracting chunk 12 as a result of the elasticity of the clip 11, and the wire extracting chunk 12 is further pushed outward until the clasp chunk 121 on the wire extracting chunk 12 jostles against the inner wall edge of the cavity 102.

Figure 5:
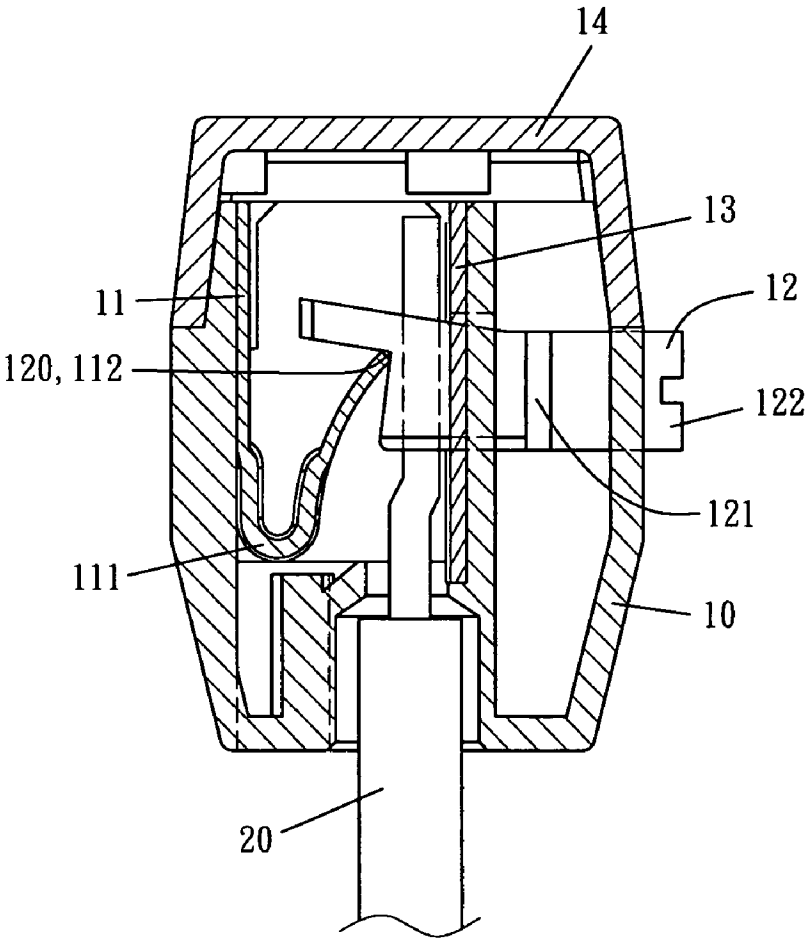
FIG. 5 is a schematic view showing the use of the electric wire for the extracting of the exemplified embodiment of the present invention.
Figure 4:
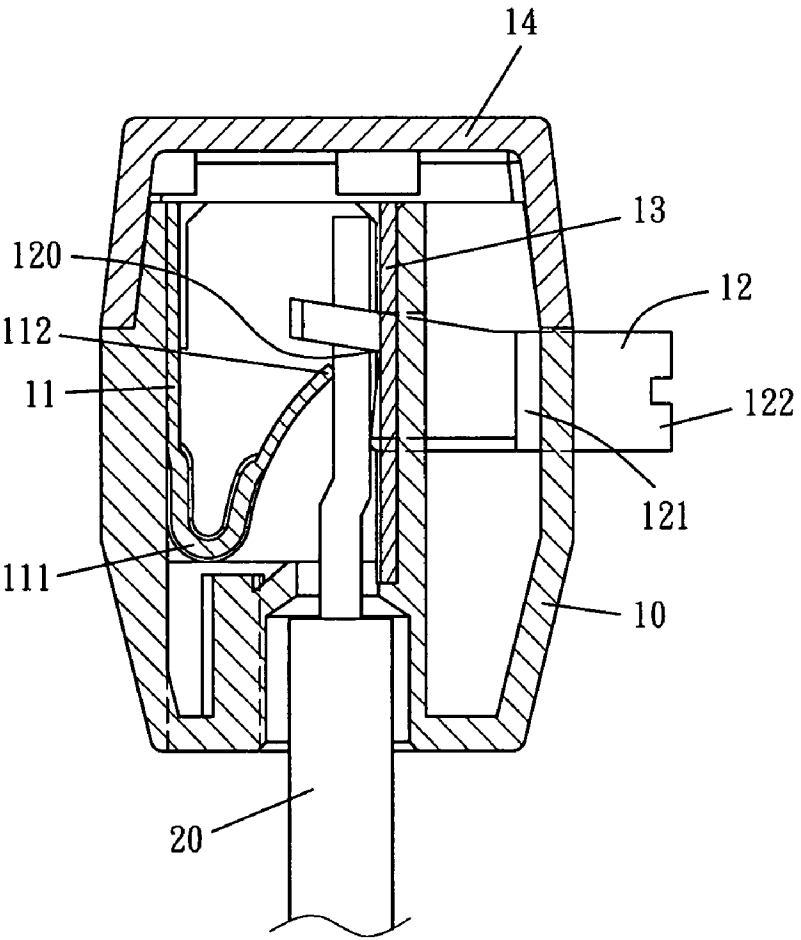
FIG. 4 is a schematic view showing the use of the electric wire for the insertion connection of the exemplified embodiment of the present invention.

The use is shown in FIG. 4. The through hole 100 is provided for the insertion by a bare end of an electric wire 20, which is formed by peeling off its skin. As the bare end of the wire 20 inserts the through hole 100, it unfastens the holding edge 112 and rises along the wall of the insert 13. By means of the joint clamp by the holding edge 112 and the insert 13, the bare end of the wire 20 can be clasped firmly; the enhanced tendons 113 at both sides of the curved segments 111 of the clip 11 can strengthen its elasticity especially, and the arcs 110, formed into arc shape, possess tension, which are all beneficial to reinforce the clamping force of the clip 11 upon the bare end of the wire 20. It is worth to note herewith that the positions of the through holes 100 and those of the wire extracting chunks 12 are interlaced so that the movement of the bare end of the wire 20 inserting the through hole 100, unfastening the holding edge 112 and rising along the wall of the insert 13 will not influence the existence of the wire extracting chunks 12. The extraction of the connected electric wire is shown in FIG. 5. Once press the push end 122 to move the wire extracting chunk 12 inward, the top indent 120 in turn presses the holding edge 112 to unfasten the bare end of the wire, and it is ready to extract the wire 20 from the through hole 100.

The function of this invention is to enable the whole conduction for each wire in the respective through hole 100 (single in multiple out or multiple in single out). Once a single wire 20 only is conducted to the power supply, the multiple wires 20 inserted for the connection are all conducted. Therefore, this invention does not confine the number of the through hole 100. It works as expected once its number is more than two. As the through holes 100 are inserted by the wires 20, the user can put a probe into the testing hole 101, and it will touch the clip 11. And the user can realize if the clip 11 is conducted, which identifies the certainty of the electric connection of this invention.

Accordingly, the clip 11 of the present invention can be augmented for its clamping force upon the wire 20 by the setup of the curved segments 111 and the tendons 112. Through the joint jostle against the electric wire 20 by the holding edge 112 and the clip 11, a sound connection and conduction can be achieved. Therefore, once the bare wire 20 being inserted in the through hole 100 of this invention, it won't come off and be secure; if the user intends an extraction of the wire 20, simply press the wire extracting chunk inward, and the top indent 120 in turn presses the holding edge 112 of the clip 11 to move inward, where the wire 20 is able to be extracted, to achieve a handy extraction.

To sum up, the disclosed techniques and the structural traits of the present invention was not known in the art, and it absolutely can accomplish the expected objective and function, which is construed as compliant to the requirements of a utility patent; the aforesaid exemplified embodiments of the present invention, are only used for describing the combination and function of this invention, and it is not intended to limit the scope of the claim of this invention. Any equivalent embodiments or modifications without departing from the spirit and scope of the present invention are therefore intended to be embraced.

What is claimed is:

1. An instant insertion and extractable wire connector, comprising a shell, a clip, at least two wire extracting chunks, an insert and a cover; the shell having its internal as a lodging space and a plurality of positioning dens as well for a positioning purpose, being provided with at least two through holes at a bottom, and having at least two cavities at a side of a top; the clip being formed out of conductive material which is lodged in the internal of the shell and held fixedly, where an one side is extended to form at least two separated curved segments, an arc being located next to the curved segment, where its bottom end forms a holding edge, and each curved segment having an enhanced tendon, where a gap is laid between two adjacent curved segments and between two adjacent arcs; the wire extracting chunks being formed by insulating material, which are one-to-one lodged in the cavities, and each wire extracting chunk inserted in the corresponding cavity having a top indent at an inner end, where a middle part is provided with a clasp chunk at a side, while an outer end is a push end; once the wire extracting chunk being lodged in the cavity, the clasp chunk being positioned at the inner wall edge of the cavity, which could confine the moving distance of the wire extracting chunk; the insert, lodged in the shell for a fixing, being in contact with the clip and is made up of conductive material, where an one side is provided with voids which has the same number as that of the wire extracting chunks, and each void being penetrated by the corresponding wire extracting chunk; the cover being capped on the shell for a fixed joining.

2. An instant insertion and extractable wire connector as in claim 1 wherein a testing hole located in the side of the through holes on the shell, where the testing hole leads to the internal of the shell.

* * * * *